United States Patent [19]

Fox et al.

[11] 3,965,531

[45] June 29, 1976

[54] INFINITE POSITION DOOR HOLD OPEN

[75] Inventors: Robert M. Fox, Warren; Gary A. Wize, Washington, both of Mich.

[73] Assignee: General Motors Corporation, Detroit, Mich.

[22] Filed: Nov. 12, 1975

[21] Appl. No.: 631,053

[52] U.S. Cl. ..... 16/140

[51] Int. Cl.[2] ..... E05D 11/08

[58] Field of Search ..... 16/49, 54, 60, 68, 82, 16/139–147

[56] References Cited

UNITED STATES PATENTS

| | | | |
|---|---|---|---|
| 3,213,484 | 10/1965 | Epple | 16/141 |
| 3,427,682 | 2/1969 | Bachmann | 16/146 |
| 3,584,333 | 6/1971 | Hakala | 16/140 |

*Primary Examiner*—G. V. Larkin

*Attorney, Agent, or Firm*—Herbert Furman

[57] ABSTRACT

An infinite position door hold open includes a pair of pivotally interconnected hinge members which are respectively mounted on the door and body. The door mounted hinge member pivotally supports an arcuate link having oppositely facing braking and frictional surfaces, both generated about the pivotal axis of the hinge members. The braking surface is frictionally engageable with a brake pad adjustably mounted on the body mounted hinge member. The engagement of the braking surface with the brake pad is controlled by pivotal movement of a wedging cam relative to the door mounted hinge member between non-wedging limit positions through an intermediate wedging position. The cam has a friction member in constant engagement with the frictional surface of the brake member. Any reversal of the direction of movement of the door relative to the body causes the friction member of the cam to move the cam to the intermediate wedging position and wedge the braking surface of the brake member into frictional engagement with the brake pad.

3 Claims, 4 Drawing Figures

INFINITE POSITION DOOR HOLD OPEN

This invention relates generally to infinite position door hold opens and more particularly to such a hold open which includes a brake member frictionally engageable with a brake by an actuating means responsive to reversal of the direction of movement of the door.

Infinite position door hold opens are known in the prior art. Hakala U.S. Pat. No. 3,584,333 shows such a hold open.

One of the features of this invention is that it provides for adjustment of the hold open effort throughout the life of the vehicle. Another feature is that the hold open is provided by a braking member movable into and out of engagement with an adjustably mounted brake pad by an actuating means responsive to reversal of the direction of movement of the door. A further feature is that the actuating means is in constant frictional engagement with an arcuate frictional surface of the brake member and reversal of the direction of movement of the door causes the actuating means to wedge an oppositely facing braking surface of the brake member into engagement with the brake pad and effect the hold open. Yet another feature is that the actuating means includes a rotatable cam in constant frictional engagement with the brake member, with the cam being normally located in a limit position during door movement and being rotatable from a limit position to a wedging position upon reversal of the direction of door movement to wedge the brake member against the brake pad. Yet a further feature is that the cam includes a frictional surface frictionally engaging a rib of the brake member and lobes straddling the rib and engaging frictional surfaces to each side thereof to engage the brake member and brake pad upon reversal of the direction of movement of the door and rotation of the cam from either limit position to the intermediate wedging position.

These and other features of the invention will be readily apparent from the following specification and drawings wherein.

Figure 1:
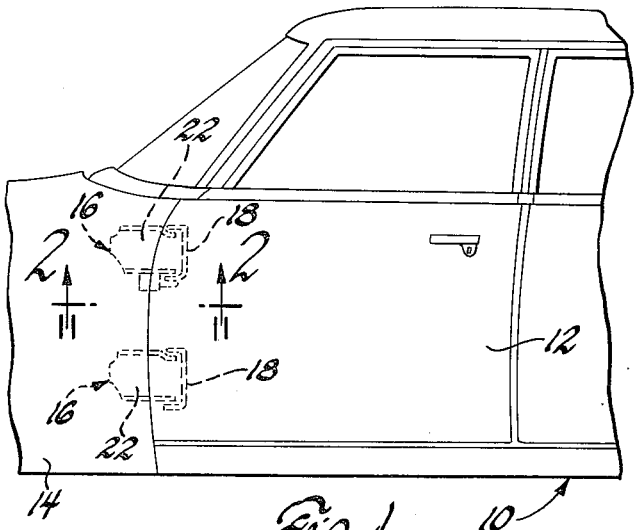
FIG. 1 is a partial side elevational view of a vehicle body having a hinged front door including an infinite position door hold open according to this invention.

Referring now particularly to FIG. 1 of the drawings, a vehicle designated generally 10 includes a front door 12 which is mounted on the body 14 of the vehicle by a pair of spaced hinges 16 for swinging movement between a closed position as shown and an open position, not shown. The hinges 16 are of identical construction except that the upper hinge member includes an infinite position door hold open according to this invention. If desired, the hold open may be alternately included in the lower hinge 16.

Figure 2:
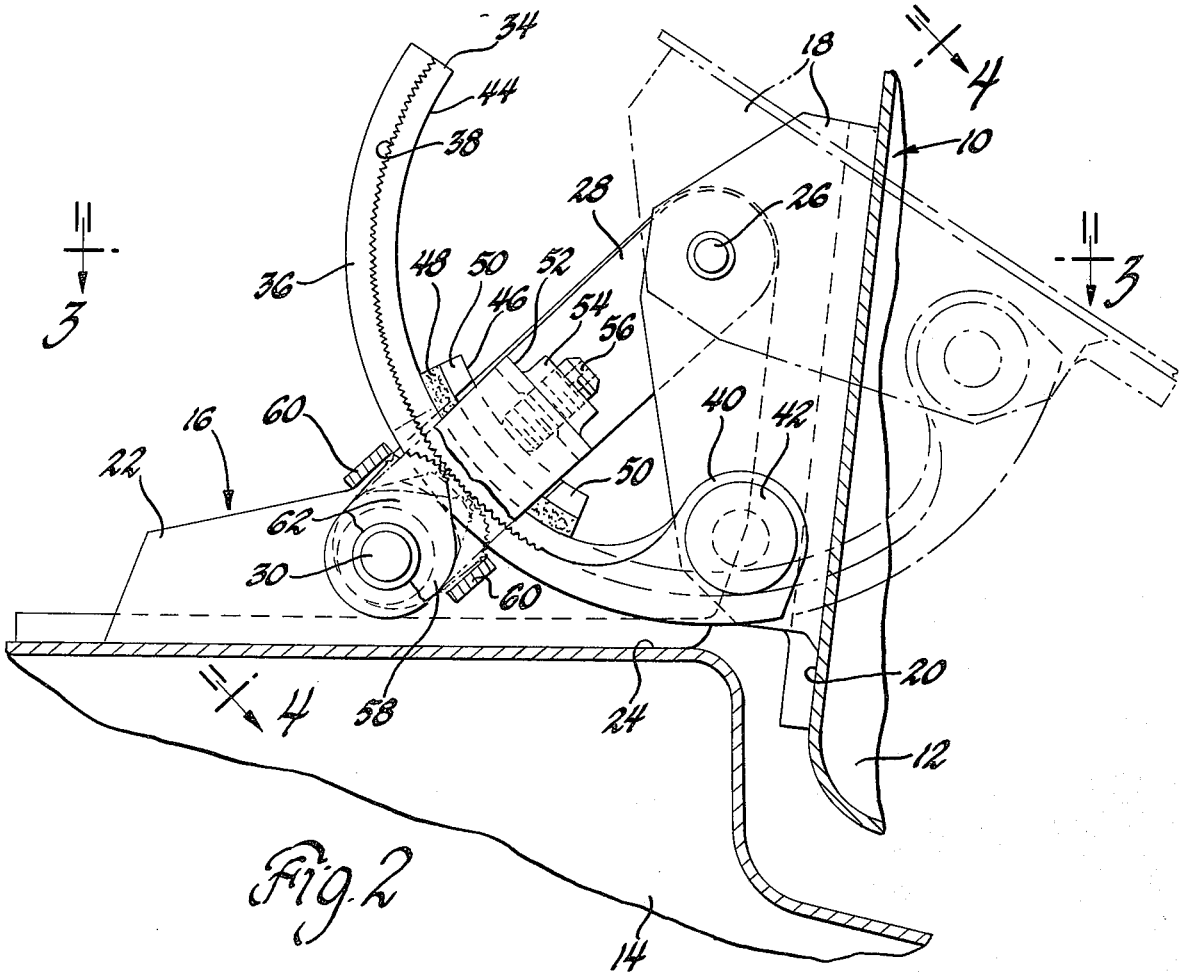
FIG. 2 is an enlarged sectional view taken generally along the plane indicated by line 2—2 of FIG. 1 and showing the door hinge and hold open in full lines in door closed position and in dashed lines in door open position.
Figure 3:
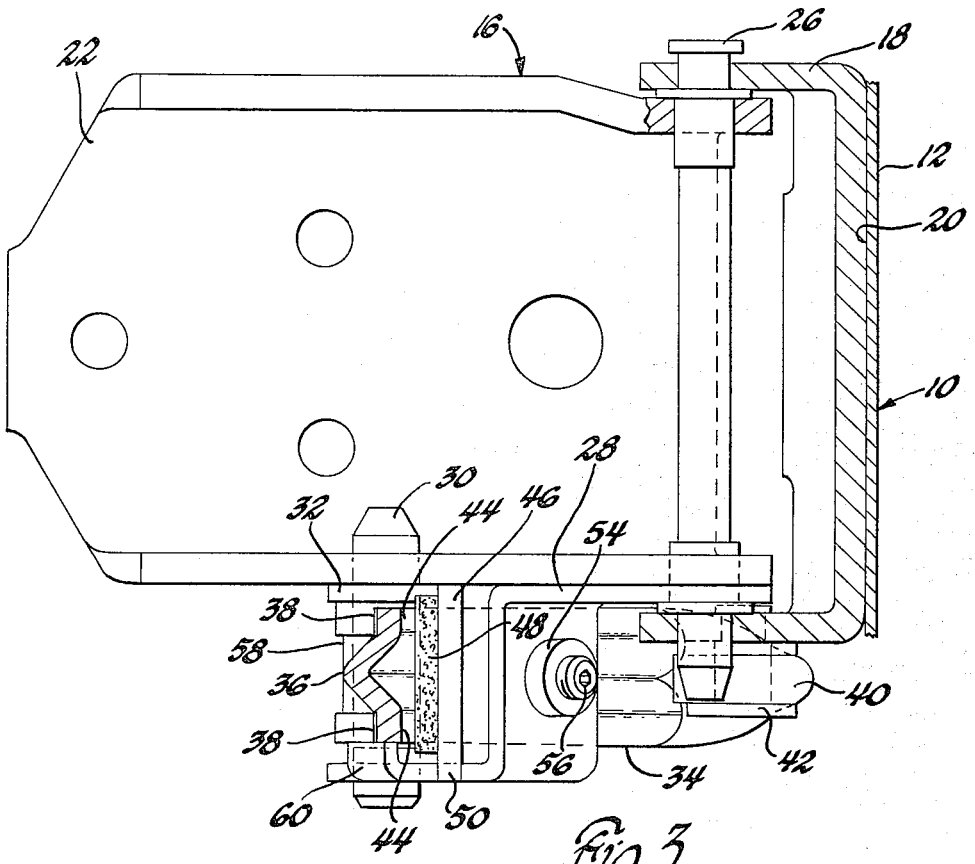
FIG. 3 is a view taken generally along the plane indicated by line 3—3 of FIG. 2.
Figure 4:
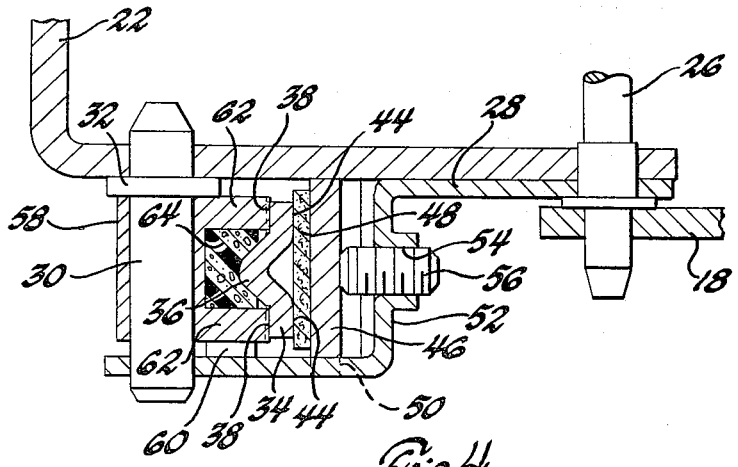
FIG. 4 is a view taken generally along the plane indicated by line 4—4 of FIG. 2.

Referring now to FIGS. 2 through 4 of the drawings, the upper hinge 16 includes a channel shaped male hinge member 18 which is conventionally secured to the front hinge pillar face 20 of door 12. A channel shaped female hinge member 22 is conventionally secured to the hinge pillar face 24 of the body 14. A shouldered pivot pin 26 pivotally interconnects the hinge members 18 and 22. The door hold open includes an angle bracket 28 having one apertured end received on the hinge pin 26 intermediate the lower flanges of hinge members 18 and 22. The other apertured end of the bracket 28 is received on a pin 30. The pin 30 is shouldered at 32 and staked within an opening in the lower flange of hinge member 22. The bracket 28 will thus remain stationary with the hinge member 22 during door opening and closing.

An arcuate brake member 34 includes an intermediate rib or shoulder 36 and a lightly knurled frictional surface 38 to each side of the rib 36. At one end, the rib 36 and member 34 are flattened and apertured to provide a mounting ear 40 for the brake member. A rivet 42 connects the ear 40 to the lower flange of the hinge member 18 to pivotally mount the brake member on this hinge member. The surfaces 44 of the brake member which face oppositely of the surfaces 38 provide braking surfaces as will be further explained. The frictional surfaces 38 and the braking surfaces 44 are both generated about the pivotal axis of the hinge members 18 and 22 as defined by pin 26. This is best seen in FIG. 2.

A brake pad assembly includes an arcuate metal backing plate 46 and an arcuate brake pad 48 which is bonded thereto. The backing plate 46 includes a pair of ears 50 which straddle the bracket 28 in order to slidably guide movement of the brake pad assembly relative to this bracket. A flange 52 of bracket 28 is provided with a tapped embossment 54. A set screw 56 threaded into the embossment 54 engages the backing plate 46 in order to control the position of the brake pad assembly relative to the flange 52 and in turn provide for adjustment of the hold open effort as will be further described.

A cam 58 is pivotally mounted on the pin 30 intermediate the shoulder 32 of this pin and bracket 28. The bracket includes a pair of lateral flanges 60, FIG. 2, which limit pivotal movement of the cam 58 relative to the pin. As indicated in FIG. 4, the cam is recessed to provide spaced upper and lower lobes 62. An insert 64 of friction material is mounted in the cam recess. As shown in FIG. 4, the insert 64 is grooved to match the contour of rib 36 of brake member 34 and the tips of lobes 62 are lightly knurled and respective to the frictional surfaces 38 of the brake member.

When the door is in closed position as shown in FIG. 2, cam 58 is in one terminal or limit position wherein the lower lobe 62 engages the left-hand flange 60 of the bracket 28. The knurled tips of the lobes 62 are slightly spaced from their respective frictional surfaces 38 of the brake member 34. However, the insert 64 frictionally engages the rib 36. The braking surfaces 44 of the brake member are slightly spaced or slidable relative to the pad 48 of the brake assembly.

Upon door opening movement, the hinge member 18 rotates counterclockwise of the hinge member 22. The frictional engagement of insert 64 and rib 36 rotates cam 58 clockwise through the wedging position shown in dash lines to the other terminal or limit position shown in dash dot lines wherein the lower lobe 62 engages the right-hand flange 60 of bracket 28. In this other limit position, the relationship of the lobes 62 to their respective surfaces 38 and the relationship of insert 64 to rib 36 is the same as in the one limit position. When the door has been opened the desired degree, a slight reversal of the direction of movement of the door, a slight door closing movement, the frictional engagement of insert 64 with rib 36 rotates cam 58 slightly counterclockwise to the wedging position. This effects a wedging engagement of the lobes 62 with the frictional surfaces 38 of the brake member 34 to effect a slight clockwise movement of this member about the pivot 42 and wedge the braking surfaces 44 against the brake pad 48 of the brake assembly and hold the door in a hold open position. The door will remain in this hold open position against any closing movement due to the normal inclination of the hinge axis of the door or otherwise. If it is desired to thereafter further open the door, this is easily effected since any movement of the door in this direction will swing the cam member 58 clockwise about the pin 30 to the other terminal or limit position to permit such movement.

Likewise if it is desired to close the door from the hold open position, movement of the door in this direction will rotate the cam 58 counterclockwise of the pin 30, as viewed in FIG. 2, to the one hold open position.

The degree of hold open effort is easily controlled by adjusting the relative position of the brake pad 48 with respect to the braking surfaces 44 of the brake member. Rotation of the set screw 56, which can be done at initial assembly or throughout the life of the vehicle, fixes the relative position of the brake pad assembly and in turn the degree of frictional engagement of the surfaces 44 with the brake pad.

Thus this invention provides an improved infinite position door hold open.

What is claimed is:

1. An infinite position door hold open comprising, in combination, a pair of pivotally interconnected hinge members movable in door opening and closing directions relative to each other, a brake pad mounted on one hinge member for movement therewith, a brake member mounted on the other hinge member for movement therewith and movement relative thereto into and out of frictional engagement with the brake pad to selectively and alternately hold the hinge members against movement or permit movement in either direction, a brake member actuator mounted on said other member, and cooperating frictionally engageable means on the brake member and brake member actuator operable upon reversal of the direction of movement of the hinge members for moving the brake member relative to the one hinge member and into frictional engagement with the brake pad to thereby hold the hinge members against movement in either direction.

2. An infinite position door hold open comprising, in combination, a pair of pivotally interconnected hinge members movable in door opening and closing directions relative to each other, a brake pad mounted on one hinge member for movement therewith, a brake member pivotally mounted on the other hinge member and including an arcuate braking surface and an arcuate frictional surface, both generated about the pivotal axis of the hinge members, an actuator rotatably mounted on said other hinge member, means limiting rotational movement of the actuator relative to said other hinge member between rotatably spaced limit positions through an intermediate wedging position, means on the actuator engageable with the frictional surface of the brake member to rotate the actuator from a limit position to the wedging position upon reversal of the direction of movement of the hinge members, and means on the actuator engageable in wedging position with the brake member to effect movement of the brake member and engagement of the braking surface thereof with the brake pad to hold the hinge members against relative movement.

3. An infinite position door hold open comprising, in combination, a pair of pivotally interconnected hinge members movable in door opening and closing directions relative to each other, a brake pad, means adjustably mounting the brake pad on one hinge member for movement therewith and adjusting movement relative thereto, a brake member pivotally mounted on the other hinge member and including an arcuate braking surface and an arcuate frictional surface, both generated about the pivotal axis of the hinge members, an actuator rotatably mounted on said other hinge member, means limiting rotational movement of the actuator relative to said other hinge member between rotatably spaced limit positions through an intermediate wedging position, means on the actuator frictionally engageable with the frictional surface of the brake member to rotate the actuator between the limit positions and through the wedging position upon full reversal of the direction of movement of the hinge members, and means on the actuator engageable in wedging position with the brake member upon initial reversal of the direction of movement of the hinge members to effect movement of the brake member relative to the other hinge member and engagement of the braking surface thereof with the brake pad to hold the hinge members against relative movement, continued movement of the actuator to the other limit position or return of the actuator to the one limit position releasing the brake member from the brake pad to permit relative movement of the hinge members.

* * * * *